United States Patent [19]

Staeger

[11] 4,456,324

[45] Jun. 26, 1984

[54] INTERIOR CONDUCTOR SUPPORT FOR HIGH FREQUENCY AND MICROWAVE COAXIAL LINES

[75] Inventor: Hanspeter Staeger, Köniz, Switzerland

[73] Assignee: Radiall Industrie, Rosny-Sous-Bois, France

[21] Appl. No.: 409,309

[22] Filed: Aug. 18, 1982

[30] Foreign Application Priority Data

Aug. 20, 1981 [CH] Switzerland ..... 5370/81

[51] Int. Cl.[3] ..... H01R 17/18

[52] U.S. Cl. ..... 339/177 R; 339/256 R

[58] Field of Search ..... 339/217 S, 177, 256 R

[56] References Cited

U.S. PATENT DOCUMENTS

| | | | |
|---|---|---|---|
| 3,079,581 | 2/1963 | Klumpp | 339/217 S |
| 3,396,364 | 8/1968 | Bonhomme | 339/217 S |
| 3,470,525 | 9/1969 | Jaaksoo et al. | 339/217 S |
| 3,641,483 | 2/1972 | Bonhomme | 339/217 S |
| 4,025,149 | 5/1977 | Spinner | 339/177 R |
| 4,108,529 | 8/1978 | Evans | 339/177 R |
| 4,163,594 | 8/1979 | Aujla | 339/177 R |
| 4,270,825 | 6/1981 | Marsh | 339/217 S |
| 4,358,179 | 11/1982 | Bourdon et al. | 339/217 S |

*Primary Examiner*—John McQuade
*Assistant Examiner*—David L. Pirlot
*Attorney, Agent, or Firm*—Brisebois & Kruger

[57] ABSTRACT

A coaxial support for an interior conductor includes at least four thin dielectric plates (d) mechanically preformed and which are seated in slits of an exterior conductor element (n), and automatically center and immobilize an interior conductor element of reduced section (i). The support, which has a relatively significant length with respect to the diameter of the exterior conductor, has great rigidity in the transverse and longitudinal directions.

4 Claims, 4 Drawing Figures

INTERIOR CONDUCTOR SUPPORT FOR HIGH FREQUENCY AND MICROWAVE COAXIAL LINES

The present invention relates to a coaxial support for an interior conductor of high frequency and microwave lines and coaxial connectors.

Coaxial lines and coaxial connectors serve in the transmission of electromagnetic waves under shielding. In coaxial devices, it is above all important that the line have a longitudinally homogeneous construction, and thus a defined characteristic impedance, and that the interior conductors arranged concentrically be fixed longitudinally and transversely with respect to the exterior conductors without this fastening being detrimental to the flow of electromagnetic waves. As to the connectors, such supports must also absorb, without mechanical deformation, the longitudinal forces of connection and disconnection.

The disk-shaped supports currently used are most often composed of a specially made solid or cellular dielectric cylindrical body which is placed between the elements of the interior conductor and the exterior conductor. This arrangement has the disadvantage of reducing the maximum transmission frequency because, due to the shortening length of the wave in the dielectric, there results already before obtaining the limit frequency of the connected coaxial line, that is for lesser frequencies, undesirable oscillation modes which interfere with the transmission.

The present invention proposes a construction which prevents this limitation of frequency and which, due to its novel construction, also improves the rigidity of the longitudinal and transverse support, relative to embodiments presently in use.

An object of the present invention is a mechanically rigid support for the interior conductor for high frequency and microwave coaxial lines and connectors, characterized by the fact that it comprises an exterior conductor element with symmetry of revolution provided with at least four slits, and an interior conductor of reduced section to keep the characteristic impedance constant over the length of the support, the interior conductor being automatically centered and immobilized longitudinally by at least four small elastic dielectric plates preformed to convex shape with respect to the median axis and placed in the slits of the exterior conductor element.

In one particular embodiment, the exterior conductor element has a reduced interior diameter with respect to the coaxial connecting line, ensuring a transmission frequency limit at least as high as a coaxial connecting line insulated by air.

In order to make the invention better understood, the structure and functioning of one embodiment will now be described with reference to the attached drawings in which.

Figure 2:
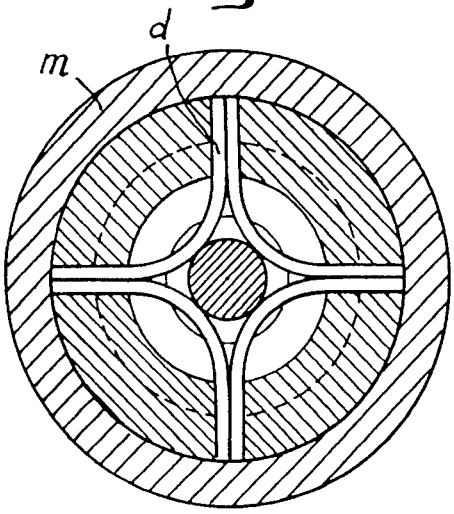
FIG. 2 is a section along A—A of FIG. 1.
Figure 2A:
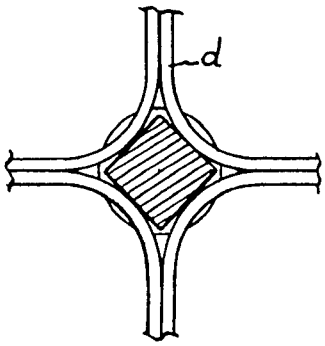
FIG. 2A is a partial view corresponding to FIG. 2 of a variation.

With reference to the drawings, it will be seen that the disk-shaped support according to the invention includes an arrangment segment of dielectric supports (d) in the shape of leaves or small plates which, in quarter-arc shape, automatically center the interior conductor (i) with respect to the exterior conductor. The interior conductor with a reduced section along length l, (FIG. 3) can have a circular section of diameter d, (FIG. 2) or a polygonal section, particularly, square (FIG. 2A), ensuring rotational immobilization with respect to the exterior conductor. A locking sleeve (m) pressed on the outside reinforces this centering and ensures locking. The dielectric supports (d) are made of a dielectric material, with low losses, which is elastically flexible, and the supports after being mechanically preformed are introduced into the slits of the exterior conductor body (n). In order to offset the electrical influence of the dielectric on the characteristic impedance, the ratio of the diameters of the exterior conductor with respect to the interior conductor must be corrected according to the characteristic impedance formula $Z=138/\sqrt{\epsilon_*}\cdot\log D_1/d_1$.

In this formula, Z represents the characteristic impedance in ohms, $\epsilon_*$ the relative dielectric constant resulting from the introduction of the dielectric plates, $D_1$ the interior diameter of the slitted element of exterior conductor n, and $d_1$ the diameter of the interior conductor. The reduction of diameter of interior conductor i and the reduction of interior diameter $D_1$ of the exterior conductor along partial length l, of the support disk, ensures in addition to mechanical fastening in the longitudinal direction, that the upper limit frequency, reduced due to the influence of the leaf dielectric, is again increased so as to be slightly greater or equal to that of the coaxial system with air insulation. The support disk of significant length with respect to the diameter ensures a high transverse mechanical resistance so that the support, as a whole, is immune to flexion forces of the interior conductor. In the exterior conductor, the longitudinal fastening of the segments of the dielectric leaves is ensured by the fact that a longitudinal edge presses at (o) at the end of the slit while the other edge comes to rest at (p) on the exterior conductor of the adjacent coaxial line to be joined.

Figure 3:
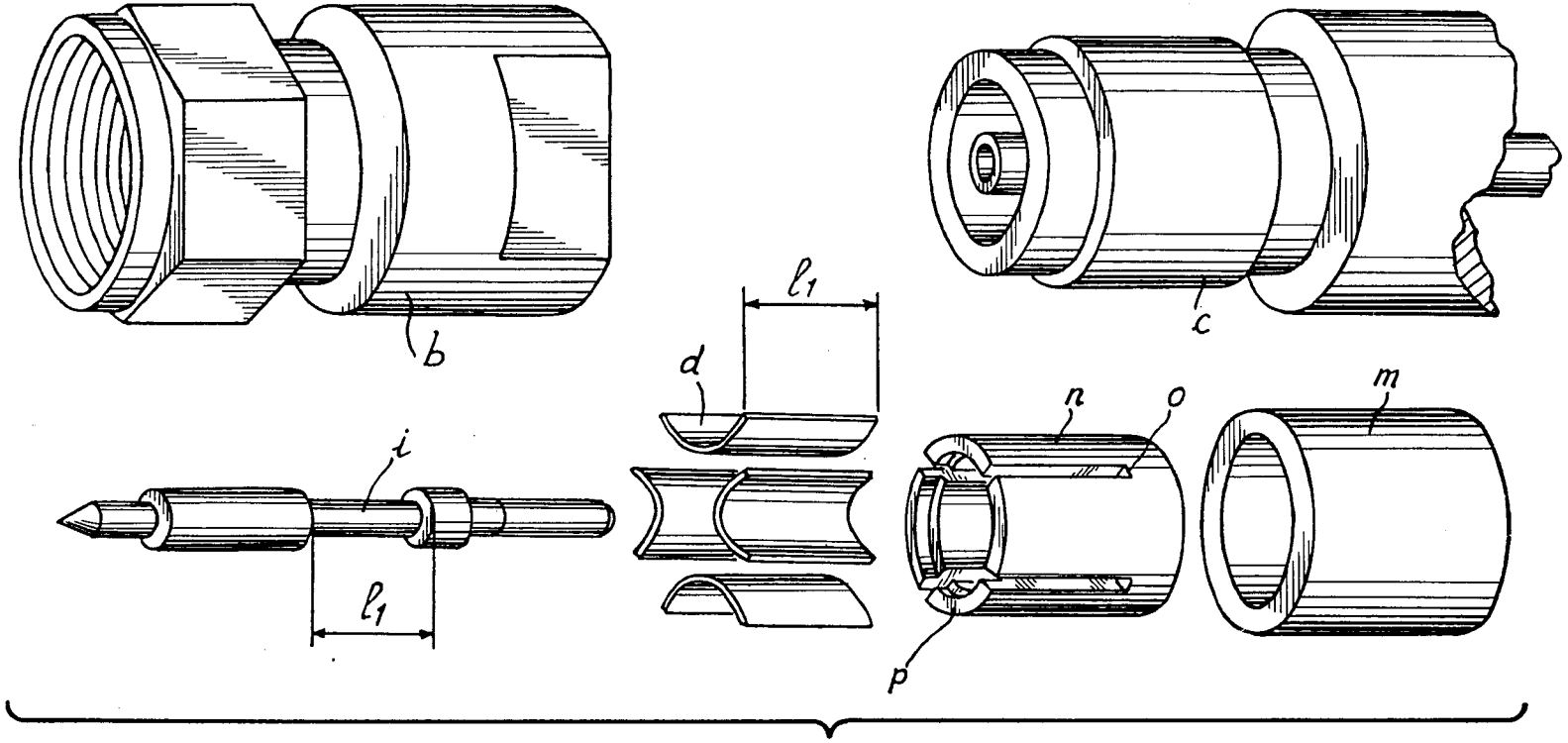
FIG. 3 is an exploded view illustrating the support according to the invention and the coaxial connecting elements of the corresponding connector, and of the connected coaxial line.

There will be seen on the exploded view of FIG. 3, in addition to the disk-shaped support construction, the corresponding connector (b) and joining coaxial line (c).

By way of example, a support disk has been made for a coaxial system with an upper limit frequency of 40 GHz and a characteristic impedance of $Z=50\Omega$ (or ohms), the coaxial dimensions being $D=3.0$ mm and $d=1.30$ mm. The support disk is made as shown on the drawing.

The dimensions can all be related to the respective dimensions of the exterior conductor and the interior conductor of the coaxial system:

Thus, $d=D.1/2,3$; $D_1\approx 0.7.D$ $d_1=0.7.d$

Length $L\sim 2.D$

Diameter $D_A$ on exterior sleeve $m\sim 1.7.D$

Support length $l_1\sim 1.3D$

Figure 1:
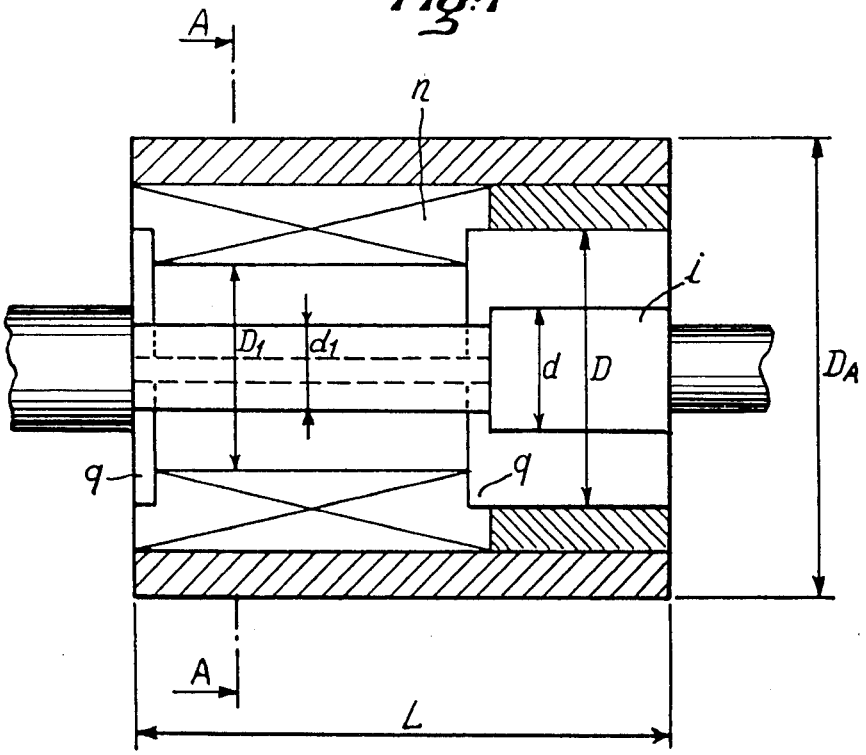
FIG. 1 illustrates an interior conductor support according to the invention.

Supplemental groove q visible on FIG. 1 in the slitted body of the exterior conductor assist in the electrical compensation of field distortions resulting from the diameter jumps D/d, to $D_1/d_1$, and are proportioned in the usual way.

I claim:

1. A mechanically rigid support of an interior conductor for high frequency and microwave coaxial lines and connectors, characterized by the fact that it includes an exterior conductor element (n) having symmetry of revolution and at least four slits, and an interior conductor (i) of reduced section to maintain a constant characteristic impedance over the length of the support, the interior conductor being automatically centered and immobilized longitudinally by at least four small elastic dielectric plates (d) preformed in convex shape with respect to the median axis and introduced in the slits of the exterior conductor element (n).

2. A support according to claim 1, characterized by the fact that the exterior conductor element (n) has an interior diameter ($D_1$) which is reduced with respect to the joining coaxial line.

3. A support according to either one of claims 1 and 2, characterized by the fact that the interior conductor (i) has a circular section in its region of reduced section.

4. A support according to either one of claims 1 and 2, characterized by the fact that the interior conductor (i) has a polygonal section, particularly square, in its region of reduced section.

* * * * *